US007798917B2

(12) United States Patent
Nguyen et al.

(10) Patent No.: US 7,798,917 B2
(45) **Date of Patent: *Sep. 21, 2010**

(54) GOLF CLUB HEAD

(75) Inventors: Vinh-Duy Thai Nguyen, Lake Forest, CA (US); Wataru Ban, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 251 days.

This patent is subject to a terminal disclaimer.

(21) Appl. No.: 11/554,821

(22) Filed: Oct. 31, 2006

(65) Prior Publication Data

US 2008/0102981 A1 May 1, 2008

(51) Int. Cl.
*A63B 53/04* (2006.01)

(52) U.S. Cl. ..... 473/330; 473/331

(58) Field of Classification Search ..... 473/324–350, 473/287–292

See application file for complete search history.

(56) References Cited

U.S. PATENT DOCUMENTS

| | | | | |
|---|---|---|---|---|
| 1,289,553 | A | 12/1918 | Sanders | |
| 1,337,958 | A | 4/1920 | Reach | |
| 2,005,401 | A | 4/1933 | Storz | |
| 1,965,954 | A | 7/1934 | Davis | |
| D190,035 | S | 4/1961 | Hansen, Jr. | |
| 3,693,978 | A | 9/1972 | East | |
| 4,067,572 | A | 1/1978 | Coleman | |
| 4,413,825 | A | 11/1983 | Sasse | |
| 4,753,440 | A | 6/1988 | Chorne | |
| 4,858,929 | A * | 8/1989 | Long | 473/290 |
| 4,957,294 | A | 9/1990 | Long | |
| 5,029,864 | A | 7/1991 | Keener | |
| 5,100,144 | A * | 3/1992 | Okumoto et al. | 473/331 |
| 5,437,088 | A | 8/1995 | Igarashi | |
| 5,591,092 | A * | 1/1997 | Gilbert | 473/330 |
| 5,637,044 | A | 6/1997 | Swash | |
| 5,688,186 | A * | 11/1997 | Michaels et al. | 473/290 |
| 5,709,616 | A | 1/1998 | Rife | |
| 5,744,780 | A | 4/1998 | Chang et al. | |
| 5,766,087 | A * | 6/1998 | Kawamatsu | 473/290 |
| 5,766,097 | A | 6/1998 | Horiuchi et al. | |
| 5,785,610 | A * | 7/1998 | Birmingham | 473/331 |
| 5,788,584 | A | 8/1998 | Parente et al. | |
| 6,733,400 | B2 | 5/2004 | Sherwood | |
| 6,814,673 | B2 * | 11/2004 | Wahl et al. | 473/331 |
| 6,849,004 | B2 | 2/2005 | Lindsay | |
| 6,981,923 | B2 | 1/2006 | Chappell | |

(Continued)

FOREIGN PATENT DOCUMENTS

| | | |
|---|---|---|
| JP | 02-026574 A | 1/1990 |

(Continued)

*Primary Examiner*—Sebastiano Passaniti
(74) *Attorney, Agent, or Firm*—Paul, Hastings, Janofsky & Walker LLP

(57) ABSTRACT

This invention provides a golf club head having a groove formed on a face of the golf club head. Each of a pair of side surfaces of the groove has a first surface leading to the face and a second surface leading to the first surface in the depth direction of the groove. A first angle between the first surfaces of each of the pair of the side surfaces is larger than a second angle between the second surfaces of each of the pair of the side surfaces.

12 Claims, 7 Drawing Sheets

U.S. PATENT DOCUMENTS

| | | | | |
|---|---|---|---|---|
| 7,014,568 | B2 * | 3/2006 | Pelz | 473/287 |
| 7,056,226 | B2 | 6/2006 | Kennedy | |
| 7,066,833 | B2 | 6/2006 | Yamamoto | |
| 7,156,751 | B2 | 1/2007 | Wahl et al. | |
| 7,159,292 | B2 | 1/2007 | Suzuki et al. | |
| 7,166,039 | B2 | 1/2007 | Hettinger et al. | |
| 7,179,175 | B2 * | 2/2007 | Kennedy, III | 473/330 |
| 7,192,361 | B2 | 3/2007 | Gilbert et al. | |
| 7,258,627 | B2 * | 8/2007 | Chappell | 473/331 |
| 7,275,999 | B2 * | 10/2007 | Sherwood | 473/290 |
| 7,285,057 | B2 | 10/2007 | Mann et al. | |
| 7,327,017 | B2 | 2/2008 | Sirinorakul et al. | |
| 2002/0016218 | A1 | 2/2002 | Takeda | |
| 2002/0042306 | A1 | 4/2002 | Chappell et al. | |
| 2002/0132683 | A1 | 9/2002 | Buchanan | |
| 2003/0008724 | A1 | 1/2003 | Griffin | |
| 2004/0087387 | A1 * | 5/2004 | Wahl et al. | 473/330 |
| 2005/0037859 | A1 | 2/2005 | Gilbert et al. | |
| 2005/0075191 | A1 | 4/2005 | Bennett | |
| 2005/0085312 | A1 | 4/2005 | Nagai et al. | |
| 2005/0130761 | A1 | 6/2005 | Vokey et al. | |
| 2005/0143187 | A1 | 6/2005 | Kennedy | |
| 2006/0003851 | A1 | 1/2006 | Chappell et al. | |
| 2006/0154739 | A1 | 7/2006 | Mann, Jr. et al. | |
| 2006/0223648 | A1 | 10/2006 | Kennedy | |
| 2007/0010346 | A1 | 1/2007 | Gilbert et al. | |
| 2007/0149312 | A1 | 6/2007 | Gilbert | |
| 2008/0020859 | A1 | 1/2008 | Yamagishi et al. | |
| 2008/0032814 | A1 | 2/2008 | Ban | |
| 2008/0051212 | A1 | 2/2008 | Voges | |
| 2008/0102981 | A1 | 5/2008 | Nguyen et al. | |
| 2008/0108453 | A1 | 5/2008 | Park et al. | |
| 2008/0125242 | A1 | 5/2008 | Ban et al. | |
| 2008/0125243 | A1 | 5/2008 | Ban | |
| 2008/0132351 | A1 | 6/2008 | Ban et al. | |
| 2008/0132352 | A1 | 6/2008 | Ban | |
| 2008/0167138 | A1 | 7/2008 | Ban et al. | |
| 2008/0242442 | A1 | 10/2008 | Gilbert et al. | |
| 2009/0011852 | A1 | 1/2009 | Solheim et al. | |
| 2009/0029797 | A1 | 1/2009 | Ban et al. | |
| 2009/0036228 | A1 | 2/2009 | Ban et al. | |
| 2009/0082129 | A1 | 3/2009 | Ban et al. | |

FOREIGN PATENT DOCUMENTS

| | | | |
|---|---|---|---|
| JP | 08-000777 | A | 1/1996 |
| JP | 08-229169 | A | 9/1996 |
| JP | 09-308715 | A | 2/1997 |
| JP | 9-70457 | A | 3/1997 |
| JP | 09-192274 | A | 7/1997 |
| JP | 09-253250 | A | 9/1997 |
| JP | 09-308714 | A | 12/1997 |
| JP | 10-015116 | A | 1/1998 |
| JP | 10-179824 | A | 7/1998 |
| JP | 10-248974 | A1 | 9/1998 |
| JP | 2001178856 | A | 7/2001 |
| JP | 2002126135 | A | 5/2002 |
| JP | 2002224250 | A | 8/2002 |
| JP | 2002-291949 | A | 10/2002 |
| JP | 2005-169129 | A | 6/2005 |
| JP | 2005-287534 | A | 10/2005 |
| JP | 2003-93560 | A | 5/2006 |
| JP | 2007-202633 | A | 8/2007 |
| JP | 2008005994 | A | 1/2008 |
| JP | 2008079969 | A | 4/2008 |
| JP | 2001-170227 | A | 8/2009 |
| WO | 00/02627 | A1 | 1/2000 |
| WO | 00/74799 | A1 | 12/2000 |
| WO | 01/97924 | A1 | 12/2001 |
| WO | 03/045507 | A1 | 6/2003 |

* cited by examiner

FIG. 6

| | GROOVE SPECIFICATIONS | | | | | | | | | | EXPERIMENTAL RESULT | | |
|---|---|---|---|---|---|---|---|---|---|---|---|---|---|
| | CROSS SECTION SHAPE | ANGLE θ1 (°) | ANGLE θ2 (°) | ROUNDING RADIUS (mm) | WIDTH W (mm) | RULE-BASED WIDTH Wr (mm) | GROOVE DEPTH D (mm) | PITCH (mm) | CROSS SECTION AREA S (mm²) | CROSS SECTION AREA RATIO (%) | DEGREE OF SCRATCHES | AMOUNT OF SPIN (rpm) | |
| | | | | | | | | | | | | DRY | WET |
| COMPARATIVE EXAMPLE 1 | SINGLE SIDE SURFACE (TRAPEZOIDAL) | 15 | – | 0 | 0.90 | 0.90 | 0.50 | 3.60 | 0.417 | 93 | 10 | 9610 | 7130 |
| COMPARATIVE EXAMPLE 2 | | 30 | | | | | | | 0.383 | 85 | 8 | 9830 | 4500 |
| COMPARATIVE EXAMPLE 3 | | 60 | | | | | | | 0.306 | 68 | 5 | 9960 | 2800 |
| COMPARATIVE EXAMPLE 4 | SINGLE SIDE SURFACE (V-SHAPED) | 90 | | | | | 0.45 | | 0.203 | 45 | 3 | 10050 | 1580 |
| COMPARATIVE EXAMPLE 5 | | 120 | | | | | 0.26 | | 0.117 | 26 | 1 | 9950 | 1170 |
| EXAMPLE 1 | SIDE SURFACE SEGMENTED INTO TWO SURFACES (WITH BOTTOM SURFACE) | 30 | 15 | 0 | 0.90 | 0.90 | 0.50 | 3.60 | 0.392 | 87 | 9 | 9850 | 4600 |
| EXAMPLE 2 | | 60 | 22 | | | | | | 0.356 | 79 | 6 | 9980 | 4100 |
| EXAMPLE 3 | | 90 | 35 | | | | | | 0.274 | 61 | 4 | 10070 | 2500 |
| EXAMPLE 4 | | | 22 | | | | | | 0.331 | 74 | 5 | 10020 | 3500 |
| EXAMPLE 5 | SIDE SURFACE SEGMENTED INTO TWO SURFACES (WITHOUT BOTTOM SURFACE) | 120 | 68 | | | | | | 0.181 | 40 | 2 | 9960 | 1500 |
| EXAMPLE 6 | SIDE SURFACE SEGMENTED INTO TWO SURFACES (WITH BOTTOM SURFACE) | | 35 | | | | | | 0.180 | | 2 | 9970 | 1450 |
| EXAMPLE 7 | | | 15 | | | | | | 0.254 | 56 | 3 | 9980 | 2000 |
| EXAMPLE 8 | SIDE SURFACE SEGMENTED INTO TWO SURFACES (WITH BOTTOM SURFACE) | 30 | 15 | 0.2 | 0.90 | 0.707 | 0.45 | 2.83 | 0.284 | 80 | 4 | 9600 | 7000 |
| EXAMPLE 9 | | 33 | | | 1.10 | 0.900 | | 3.60 | 0.370 | 82 | 5 | 9774 | 6100 |

GOLF CLUB HEAD

BACKGROUND OF THE INVENTION

1. Field of the Invention

The present invention relates to a golf club head, and in particular to a groove formed on the face thereof.

2. Description of the Related Art

It is provided on a face of a golf club head plurality of grooves, called marking line, score line or face line grooves. These grooves affect an amount of spin of a ball. In the case of the golf club head of an iron club, especially the wedge, it is desirable to form the grooves in order to increase the amount of spin of a ball.

Japanese Patent Application Laid-Open No. 9-192274 discloses a golf club having grooves of V-shaped or trapezoidal cross section. Japanese Patent Application Laid-Open No. 9-70457 and No. 10-179824 disclose a golf club head having grooves edges (boundary portions between side surfaces of the grooves and a face) of which are rounded. This rounding has an effect of preventing a golf ball from getting damaged (for example, scratches and the like). Japanese Patent Application Laid-Open No. 2003-93560 and No. 2005-287534 disclose a golf club head having grooves each of which has a side surface formed not by a single surface, but by two differently angled surfaces. Incidentally, a golf club head used in official games is subject to constraints on the width and depth of a groove specified by the rules. Therefore, in consideration of applications in official games, it is required to design a golf club head in a range to meet the rules.

Now, an amount of spin of a golf ball in the rain or hitting a shot in the rough tends to be smaller than without the rain or hitting on the fairway. For preventing the amount of spin of a ball in the rain or a shot in the rough from decreasing, it is effective to enlarge a volume of a groove on the face. The enlargement of the volume of the groove allows grass and dust sandwiched between the face and a ball to easily get away into the groove and improves drainage performance of water existing on the face.

A groove having a rectangular cross section can have the largest volume of the groove compared to a groove having the same width and a differently shaped cross section. However, a ball is easily damaged because of an increase in sharpness of the edge of the groove.

On the contrary, a V-shaped or trapezoidal cross section of the groove allows a ball to be less damaged compared to the rectangular cross section. However, the volume of the groove is liable to be small. Therefore, when hitting a shot in the rain or in the rough, the amount of spin of a ball tends to be largely reduced.

In the golf club head disclosed in Japanese Patent Application Laid-Open No. 2003-93560, an enlargement of a volume of groove may increase sharpness of the groove edges, and therefore, a ball may be susceptible to damage. The golf club head disclosed in Japanese Patent Application Laid-Open No. 2005-287534 may be unworkable, because a groove width on the face is narrower than that within the groove. Further, increasing sharpness of the groove edges makes a ball more susceptible to damage. Japanese Patent Application Laid-Open No. 2005-287534 also discloses rounding of the groove edges, however, when the groove edges take an angle as sharp as the grooves of Patent Application Laid-Open No. 2005-287534, a ball may be also likely to suffer damage even if the edges are rounded.

SUMMARY OF THE INVENTION

The present invention has been made in order to overcome the deficits of prior art.

According to the aspects of the present invention, it is provided a golf club head comprising a groove formed on a face of the golf club head, and each of a pair of side surfaces of said groove having a first surface leading to the face and a second surface leading to the first surface in the depth direction of said groove, wherein a first angle between the first surfaces of each of the pair of the side surfaces is larger than a second angle between the second surfaces of each of the pair of the side surfaces.

In this golf club head, the first angle between the first surfaces of each of the pair of the side surfaces is larger than the second angle between the second surfaces of each of the pair of the side surfaces. The first surface can contribute to preventing a ball from getting damaged and the second surface can contribute to securing a volume of the groove. Therefore, the present invention can prevent the amount of spin of a ball in the rain or a shot in the rough from decreasing largely and also the ball from getting damaged.

Other features and advantages of the present invention will be apparent from the following descriptions taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 6 shows the experimental conditions and the results of examples of the present invention and comparative examples.

DESCRIPTION OF THE EMBODIMENTS

Preferred embodiments of the present invention will now be described in detail in accordance with the accompanying drawings.

Figure 1A:
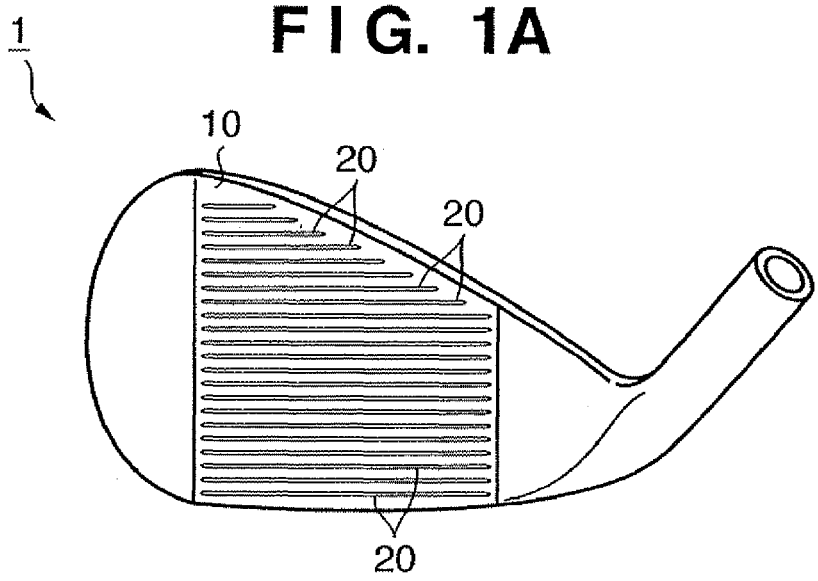
FIG. 1A is a general view of a golf club head 1 according to one embodiment of the present invention.

FIG. 1A is a general view of a golf club head 1 according to one embodiment of the present invention. In FIG. 1, an example is shown when the present invention is applied to an iron type golf club head. The present invention is suitable for golf club heads especially for wedges such as a sand wedge, a pitching wedge or an approach wedge for which a large amount of spin of a ball is required. However, the present invention is also applicable to a golf club head for a utility golf club or a wood golf club.

Figure 1B:
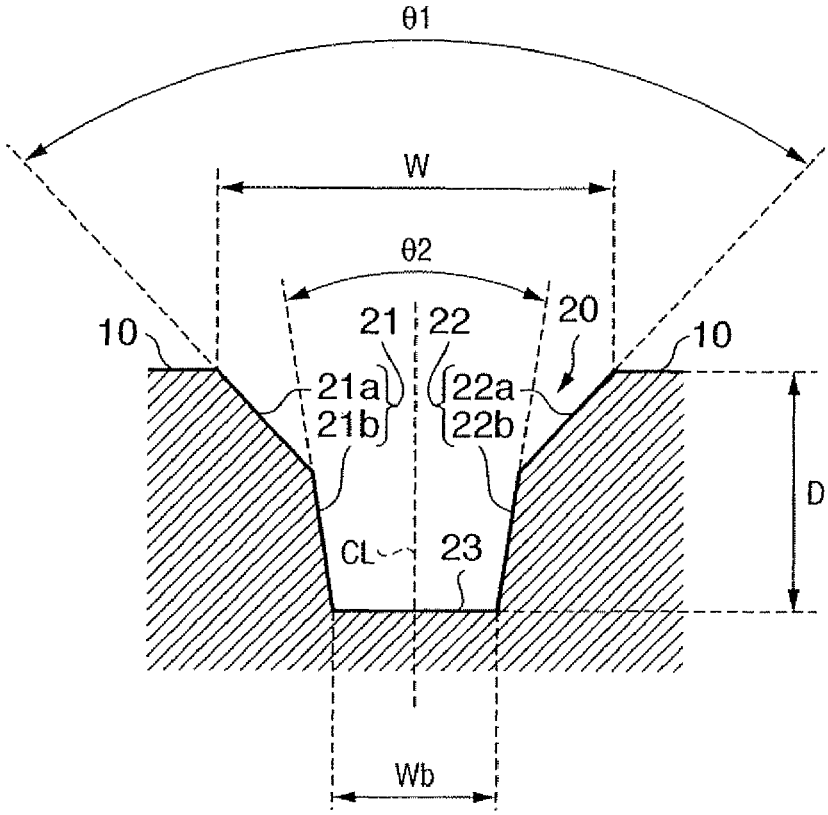
FIG. 1B is a cross sectional view of a groove 20.

The golf club head 1 has a plurality of grooves 20 formed on the face 10 thereof. In this embodiment, each of the grooves 20 is a straight groove extending in toe-to-heel direction and each pitch between the adjacent grooves 20 is arranged to be equal (each pitch has the same length) FIG. 1B is a cross sectional view taken in the direction perpendicular to the longitudinal direction (toe-to-heel direction) of any one of the grooves 20. In this embodiment, the groove 20 has the same cross section shape in the longitudinal direction except for both distal ends thereof. Further, each of the plurality of grooves 20 has the same cross section shape.

The groove 20 has a pair of side surfaces 21 and 22, and a bottom surface 23. In this embodiment, the cross section shape of the groove 20 is symmetric about the center line CL thereof. Each of the pair of the side surfaces 21 and 22 comprises a first surface 21*a*, 22*a* leading to the face 10, and a second surface 21*b*, 22*b* leading to the first surface 21*a*, 22*a* in the depth direction of the groove 20. The bottom surface 23 is parallel to the face 10 and leads to the second surfaces 21*b* and 22*b*.

The groove 20 has a bottom width Wb, a depth D and a width W. The bottom width Wb indicates a distance between both ends of the bottom surface 23. The depth D indicates a distance from the face 10 to the bottom surface 23. The width W is a width of the groove 20 in the direction perpendicular to the longitudinal direction thereof, and indicates a distance between both edges of the groove 20 (from the boundary portion between the first surface 21*a* and the face 10 to the boundary portion between the first surface 22*a* and the face 10). Further, when edges of the groove 20 are rounded with a radius r as shown in FIG. 2A, the width W is measured from the starting point to get rounded (the position shown by a broken line in FIG. 2) to that of the opposite side.

This rounding can provide an effect to protect a ball from damage (scratches and the like), and the radius r is preferably equal to or more than 0.05 (mm) and not more than 0.3 (mm). Moreover, from the viewpoint of an amount of spin of a ball, the radius r is more preferably equal to or more than 0.05 (mm) and not more than 0.1 (mm).

The term "width of groove" used herein means a width w measured by the method above described, and the width is distinguished from a width measured based on so-called the 30 degrees measurement rule in the R&A regulation which is a method for measuring a groove width of a golf club head used for official games. As shown in FIG. 2C, under the 30 degrees measurement rule, a distance between points at which imaginary lines L forming 30 degrees from the face 10 contact with the side surfaces 21 and 22 respectively is measured as a width (Wr) of the groove 20. The width measured based on the 30 degrees measurement rule hereinafter is called "rule-based width".

Figure 2A:
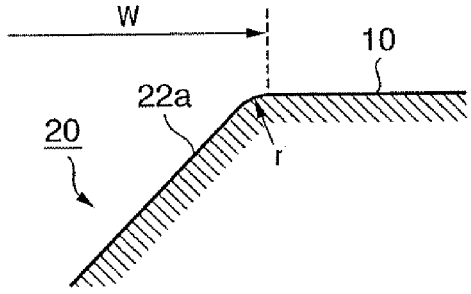
FIG. 2A is a schematic diagram illustrative of the groove 20 when an edge thereof is rounded.
Figure 2B:
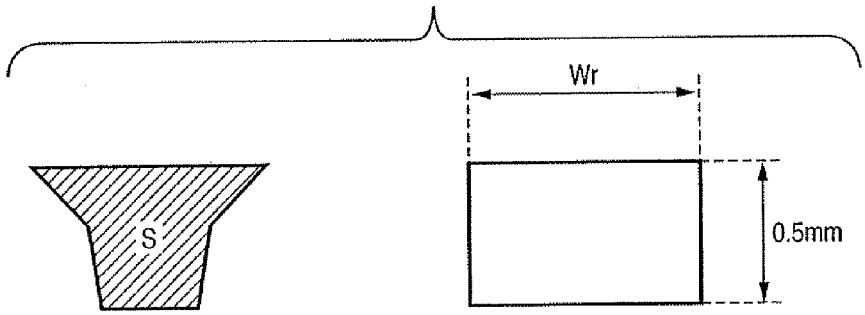
FIG. 2B is a schematic diagram illustrative of a cross section area ratio.
Figure 2C:
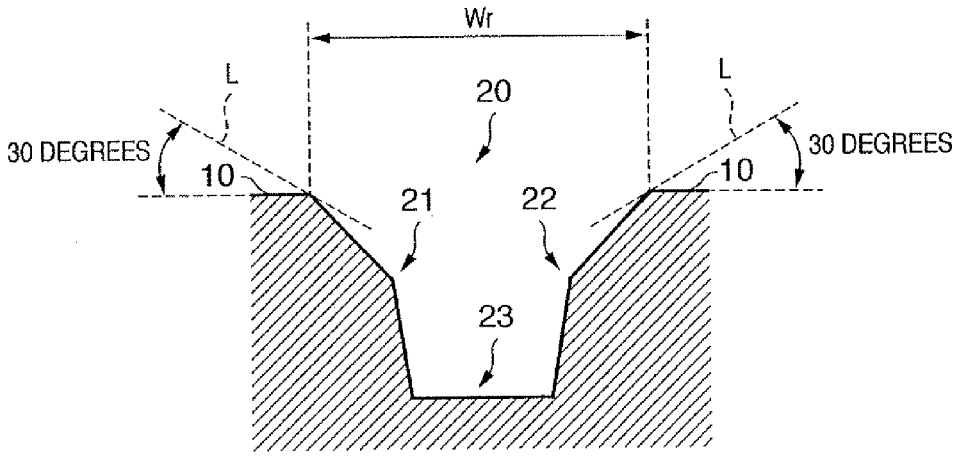
FIG. 2C is a schematic diagram illustrative of the 30 degrees measurement rule.

When edges of the groove 20 are rounded as shown in FIG. 2A, the width W of the groove 20 may be different from the rule-based width Wr. When edges of the groove 20 are not rounded, the width W of the groove 20 conforms to the rule-based width Wr. Further, the rule-based width Wr is stipulated to be not more than 0.9 (mm). The depth D of the groove 20 is also stipulated in the rules to be not more than 0.5 (mm).

Now, referring again to FIG. 1B, an angle θ1 between the first surfaces 21*a* and 22*a* is larger than an angle θ2 between the second surfaces 21*b* and 22*b*. Because an increase in the angle θ1 makes angles of edges of the groove 20 (i.e. angles of boundary portions between the first surfaces 21*a* and 22*a* and the face 10) wider, a ball can be prevented from getting damaged. Thus, the first surface 21*a* and 22*a* can contribute to preventing a ball from getting damaged.

Next, the fact that the angle θ2 is smaller than the angle θ1 can contribute to a further increase in a volume of the groove 20. In more detail, a configuration in which the side surfaces 21 and 22 of the groove 20 comprise the first surface 21 *a*, 22*a* and the second surface 21 *b*, 22*b* which are tilted by different angles from one another can provide a wider width at the bottom side, compared to a configuration in which the side surfaces 21 and 22 comprise only the first surface 21*a*, 22*a*. That is, this can increase the volume of the groove 20. Therefore, portions of the groove 20 may share the function, i.e. the second surfaces 21*b* and 22*b* can contribute to securing the volume of the groove.

In such a manner, this embodiment can prevent the amount of spin of a ball in the rain or a shot in the rough from decreasing largely and also a ball from getting damaged.

The larger the cross section area of the groove 20 is, the larger the volume of the groove 20 becomes. A cross section area ratio as an evaluation indicator of an amplitude of the cross section area of the groove 20, i.e. an amplitude of the volume of the groove 20 will be proposed as described below. As described previously, the depth D of the golf club head for official games is stipulated in the rules to be not more than 0.5 (mm). Therefore, when edges of the groove 20 are not rounded and the rule-based width Wr is applied to the groove 20, the largest cross section area of the groove 20 is Wr (mm)×0.5 (mm)=0.5·Wr ($mm^2$), as shown in the right side portion of FIG. 2B.

Now, the cross section area ratio of the cross section area S ($mm^2$) of the groove 20 (see the left side portion of FIG. 2B) to this largest cross section area can be an evaluation indicator which represents the amplitude of the volume of the groove 20. The cross section area ratio is expressed in the following expression (1). As will be described later, the ratio is preferably equal to or more than 70%.

The cross section area ratio (%)=S/(Wr×0.5)×100 . . . expression (1)

<Examples of Cross Section Shape>

Figure 3:
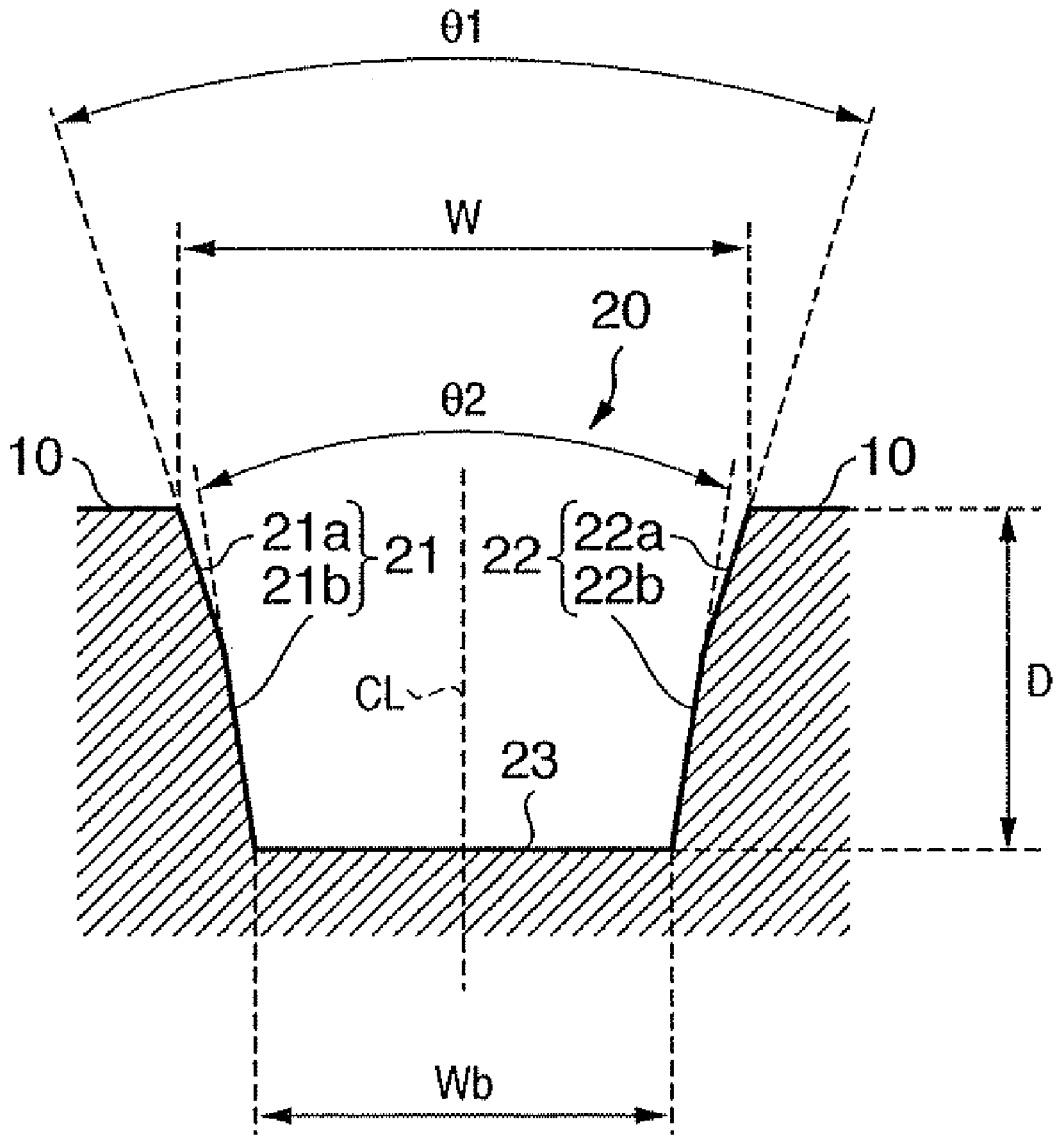
FIG. 3 is a cross sectional view showing an example of a cross section shape of a groove.

FIG. 3 shows a cross section shape in which an angle θ1 is smaller than that of the example shown in FIG. 1B. The smaller the angle θ1 is, the larger the cross section area of the groove 20 becomes and the larger the volume of the groove 20 becomes, as shown in the example in FIG. 3. However, the smaller the angle θ1 is, the smaller the angle of an edge of the groove 20 becomes, which may tend to damage a ball. In this case, as described previously, it is desirable to round edges of the groove 20.

When the angle θ1 is not more than 50 degrees, it is desirable to round edges of the groove 20, and in this case, as mentioned above, a radius r for rounding is preferably equal to or more than 0.05 (mm) and not more than 0.3 (mm), and further, more preferably equal to or more than 0.05 (mm) and not more than 0.1 (mm). On the contrary, a too smaller angle θ1 may tend to cause a ball to be damaged even through the edges of the groove 20 are rounded. Therefore, the angle θ1 is preferably equal to or more than 10 degrees.

Figure 4:
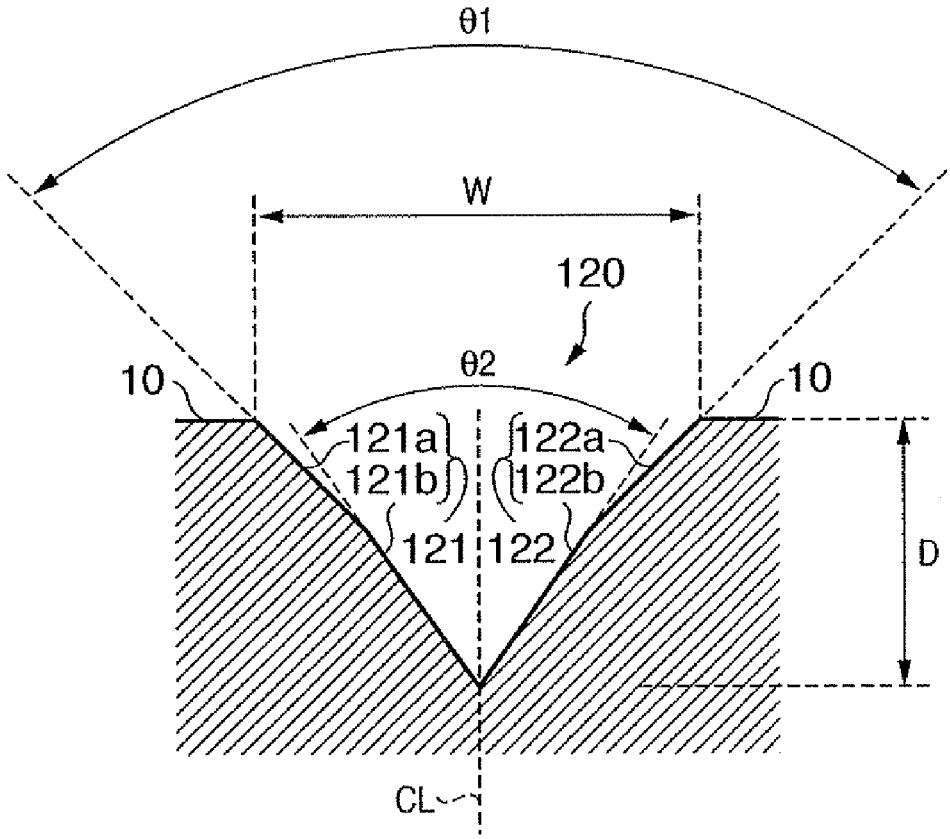
FIG. 4 is a cross sectional view showing an example of a cross section shape of a groove.

Next, while the groove 20 shown in FIG. 1B has the bottom surface 23, a groove without a bottom surface can be used. However, provision of the bottom surface allows the larger cross section area to be easily accomplished. FIG. 4 is a cross sectional view of a groove 120 without a bottom surface. The groove 120 is configured similar to the groove 20 except for the bottom surface being omitted, and comprises a pair of side surfaces 121 and 122. In this embodiment, the groove 120 is symmetric about the center line CL thereof in cross section shape. Each of the pair of the side surfaces 121 and 122 of the groove 120 comprises a first surface 121*a*, 122*a* leading to the face 10, and a second surface 121*b*, 122*b* leading to the first surface 121*a*, 122*a* in the depth direction of the groove 120. Moreover, an angle θ1 between the first surfaces 121*a* and 122*a* of the groove 120 is larger than an angle θ2 between the second surfaces 121*b* and 122*b* of the groove 120.

EXAMPLE

FIG. 6 shows the experimental results of a degree of ball damage (degree of scratches) and an amount of ball spin measured with varying specifications of grooves for examples 1 to 9 of the present invention and for comparative examples 1 to 5 to which conventional groove structures were adopted. The experiments were performed by using a sand wedge with a loft angle of 56 degrees, providing grooves in the sand wedge to which different specifications in shape were applied, and hitting unused balls by the wedge driven by a robot machine. The head speed of the sand wedge was set to 40 (m/s). Taking cases of shots in clear weather and cases of shots in the rain and in the rough into consideration, for the dry face (dry) and for the face covered with a thin wet paper (wet), ten balls were hit, respectively.

Figure 5A:
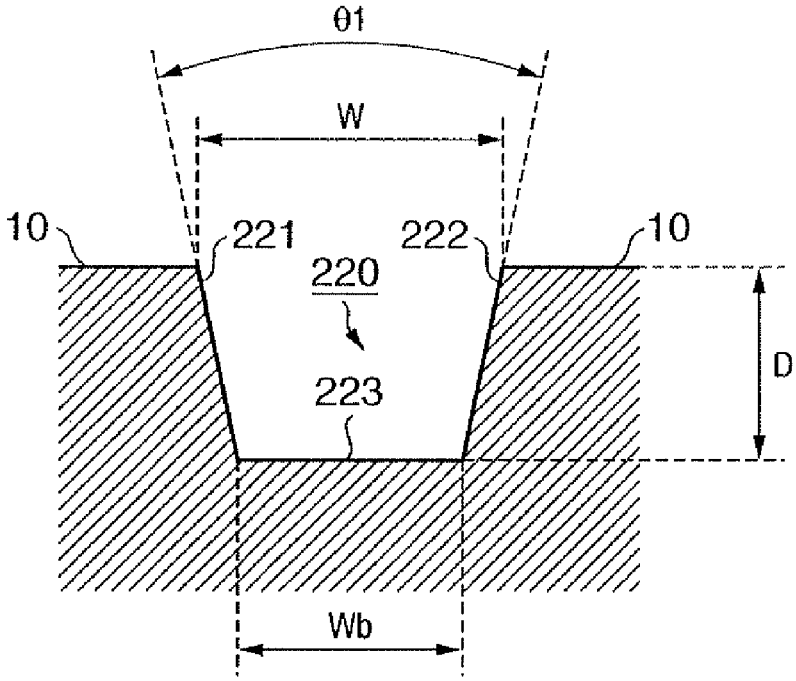
FIGS. 5A and 5B are cross sectional views showing cross section shapes of grooves of comparative examples.

In FIG. 6, the column of "Groove specifications" specifies specifications of grooves of the comparative examples and examples. The column of "Cross section shape" shows cross section shapes of grooves of the comparative examples and examples. "A single side surface (trapezoidal)" in the comparative examples 1 to 3 represents the cross section shape of a groove 220 shown in FIG. 5A, and the groove 220 is symmetric about the center line thereof. An angle θ1 is such that is formed between a side surface 221 and a side surface 222, and each of the side surfaces 221 and 222 is a single surface having no angle change therein. A depth D is a distance from the face 10 to a bottom surface 223, and a width W of the groove 220 is a distance between edges of the groove 220.

Further, in each of the comparative examples 1 to 5 and the examples 1 to 7, edges of the groove are not rounded (a radius r for rounding=0), and therefore, in each case, the width W conforms to the rule-based width Wr and is set to 0.9 (mm) as shown in FIG. 6. On the contrary, in each of the examples 8 and 9, edges of the groove are rounded (a radius r for rounding=0.2), and then, the width W does not conform to the rule-based width Wr. However, in each of the examples 8 and 9, the rule-based width Wr is not more than 0.9 (mm).

Figure 5B:
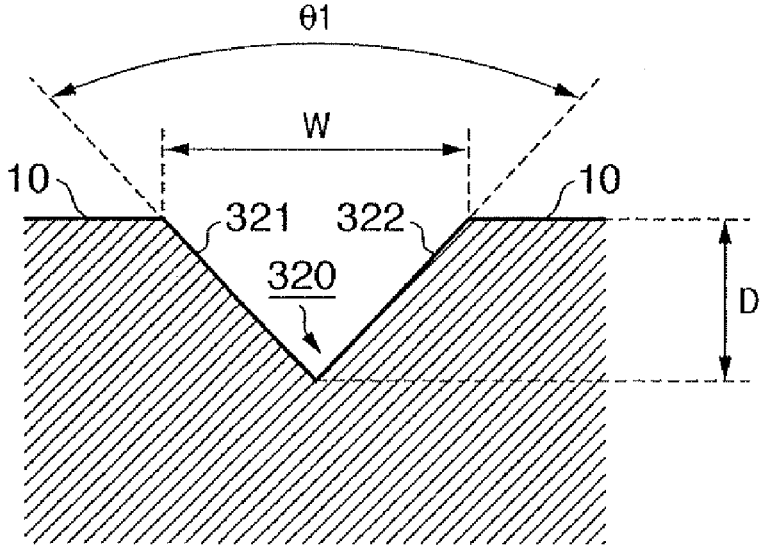

"A single side surface (V-shaped)" in the comparative examples 4 and 5 represents the cross section shape of a groove 320 shown in FIG. 5B, and the groove 320 is symmetric about the center line thereof. An angle θ1 is such that is formed between a side surface 321 and a side surface 322, and each of the side surfaces 321 and 322 is a single surface having no angle change therein. A depth D is a distance from the face 10 to an intersection of the side surface 321 and 322. A width W of the groove 320 is a distance between edges of the groove 320.

"A side surface segmented into two surfaces (with a bottom surface)" in the examples 1 to 4 and 6 to 9 represents the cross section shapes shown in FIG. 1B and FIG. 3. "A side surface segmented into two surfaces (without a bottom surface)" in the example 5 represents the cross section shape shown in FIG. 4.

"Angle θ1", "Angle θ2", "Width W" and "Groove depth D", respectively, are dimensions represented by the corresponding reference characters shown in FIG. 1B, FIG. 3 and FIGS. 4A and 4B. Further, "Groove depth D" is set to 0.5 (mm), i.e. the largest value of the depth by the rule of the groove. "Cross section area S" is a cross section area of each groove. "Cross section area ratio" is calculated by using the expression (1) above. "Pitch" in FIG. 6 is a distance between adjacent grooves and each pitch is set to 3.60 (mm) except for the example 8.

Next, in the column of "Experimental results", "Degree of scratches" for the dry face was evaluated in 1-to-10 scale by the three persons who observed visually and tactilely a degree of damage incurred on the surface of a ball after hitting. In this experiment, 10 was assigned to the largest degree of scratches on the surface of a ball and 1 was assigned to the smallest degree of scratches. "Amount of spin" was derived from a change in the position of an indicator marked in advance on the surface of a ball measured by video recording of the ball upon impact. The amount of spin is the average value of ten shots, for the dry face and for the wet face, respectively.

Figure 7A:
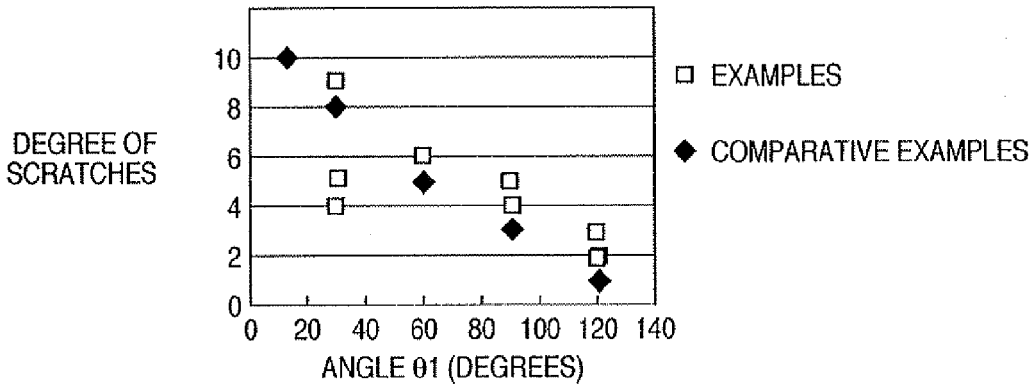
FIGS. 7A to 7C shows the experimental results of examples of the present invention and comparative examples.

FIG. 7A shows a graph of the experimental results shown in FIG. 6 plotted for illustrating the relation between "Angle θ1" and "Degree of scratches". A smaller angle θ1 means a smaller angle of groove edges and a larger angle θ1 means a larger angle of groove edges. Both the comparative examples and the examples exhibit a similar tendency, and the smaller the angle θ1 is, the larger the degree of scratches on the surface of a ball becomes, and the larger the angle θ1 is, the smaller the degree of scratches on the surface of a ball becomes. While, in the examples 8 and 9 in which groove edges were rounded, the degree of scratches was smaller, compared to those of the comparative example 2 and the example 1 which have an almost similar value of the angle θ1 as the examples 8 and 9. This shows that rounding of groove edges has an effect to prevent a ball from damage.

The degree of scratches of a ball evaluated as equal to or more than 8 is such a degree that the ball may be difficult for practical use in a sequence of several holes. Therefore, when groove edges are not rounded, it may be desirable that the angle θ1 be equal to or more than 50 degrees.

Figure 7B:
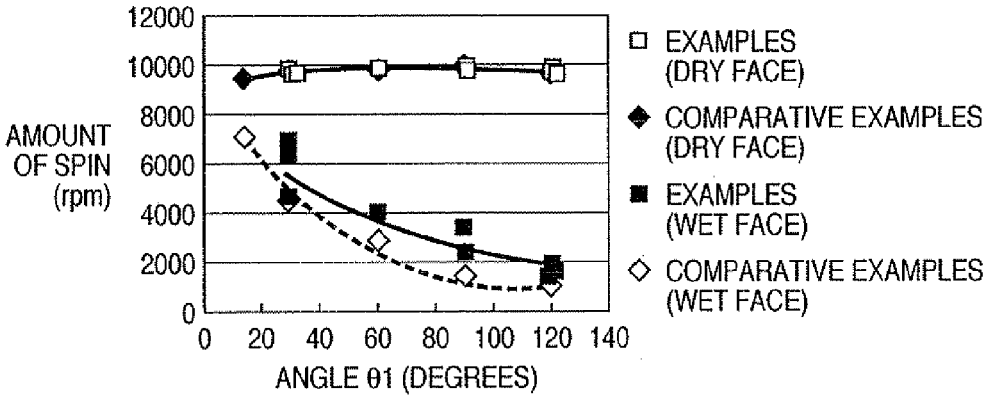

FIG. 7B shows a graph of the experimental results shown in FIG. 6 plotted for illustrating the relation between "Angle θ1" and "Degree of scratches" in a separate form for the dry face and for the wet face. In the dry face, both the comparative examples and the examples exhibit a similar tendency. From this experimental results, in the dry face, a considerable dependence of the amount of spin on the angle θ1 is not seen. In the wet face, it is seen that the amount of spin varies with the angle θ1, and it can be seen, as a whole tendency, that the amount of spin in the examples has lower drop than that in the comparative examples.

In the example 2 with the angle θ1 of 60 degrees and the example 4 with the angle θ1 of 90 degrees, drop in the amount of spin is more restrained, compared to the comparative examples 3 and 4 similarly with the angle θ1 of 60 and 90 degrees. It may be conceivable that this is attributed to the difference between the cross section areas S. In other words, it can be considered that in the case of the examples with the same value of the angle θ1 as the comparative examples, because a larger cross section area can be accomplished to release a larger amount of moisture into grooves, the drop in the amount of spin is more restrained. On the contrary, for the angle θ1 beyond 100 degrees, the difference between the comparative examples and the examples almost disappears. Therefore, it is preferable that the angle θ1 be not more than 100 degrees.

Each of the comparative example 2 and the examples 1, 8 and 9 with the angle θ1 of about 30 degrees, in the wet face, had lower drop in the amount of spin. In these cases, the example 8 has the lowest drop in the amount of spin and it can be considered that this is attributable to an effect from a narrower groove pitch of the example 8 than those of the comparative example 2 and the examples 1 and 9. The example 9 has the lowest drop in the amount of spin next to the example 8. It can be considered that this occurs also due to a wider width W than those of the comparative example 2 and the example 1.

Figure 7C:
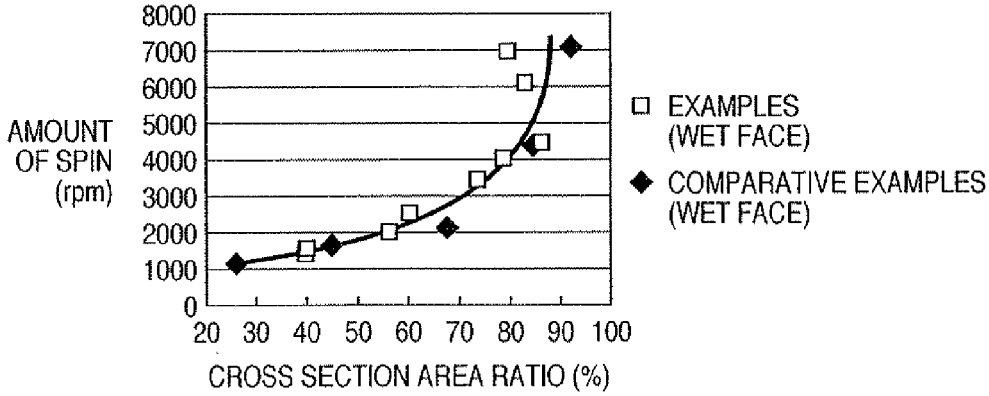

FIG. 7C shows a graph of the experimental results shown in FIG. 6 plotted for illustrating the relation between "Cross section area ratio" and "Amount of spin" for the wet face. Both the comparative examples and the examples exhibit a similar tendency, and in the wet face, there is a correlation between the amount of spin and the cross section area ratio. The plotted curve begins to rise from about 70(%) of the cross section area ratio to exhibit improvement in the amount of spin for the wet face. The curve, then, rises more sharply from the point exceeding about 80(%) of the cross section area ratio. Therefore, in the examples, the cross section area ratio is desirably equal to or more than 70(%), and more desirably equal to or more than 80(%).

In the examples, when the cross section area ratio is equal to or more than 80(%), it is difficult to realize this ratio where the angle θ1 is beyond 50 degrees due to groove design constraints. Accordingly, when the cross section area ratio is set to the value of equal to or more than 80(%), the angle θ1 is preferably not more than 50 degrees. In this case, from the view point of "Degree of scratches", groove edges is preferably rounded, and in addition, the angle θ1 is preferably equal to or more than 10 degrees.

Therefore, based on the experimental results above, in the examples of the present invention, when groove edges are not rounded, it is preferable that the angle θ1 is equal to or more than 50 degrees and not more than 100 degrees, and the cross section area ratio is equal to or more than 70(%). When the angle θ2 is not more than 30 degrees, it can be easily designed to set the cross section area ratio to the value of more than 70(%), then, the angle θ2 is preferably not more than 30 degrees.

On the contrary, when the cross section area ratio of more than 80(%) is achieved, the drop in the amount of spin can be further restrained, and in this case, it is preferable that the angle θ1 be equal to or more than 10 degrees and not more than 50 degrees, and that groove edges be rounded. When the angle θ2 is not more than 30 degrees, also, it can be easily designed to set the cross section area ratio to the value of more than 80 (%), thus, the angle θ2 is preferably not more than 30 degrees and more preferably not more than 15 degrees.

For the experimental results above described, specifications of a groove specifying that the groove rule-based width Wr is not more than 0.9 (mm) were established. When the golf club head of the present invention is used in regular games, it is required that the groove rule-based width Wr is not more than 0.9 (mm). However, the narrower the groove rule-based width Wr is, the smaller the cross section area of the groove becomes. Therefore, the groove rule-based width Wr of the golf club head of the present invention may be preferably equal to one or more than 0.6 (mm) and not more than 0.9 (mm).

While the present invention has been described with reference to exemplary embodiments, it is to be understood that the invention is not limited to the disclosed exemplary embodiments. The scope of the following claims is to be accorded the broadest interpretation so as to encompass all such modifications and equivalents structures and functions.

What is claimed is:

1. A golf club head comprising:

a plurality of grooves formed on a face of the golf club head; and a pair of side surfaces of said groove, each side surface having a first flat surface contiguous with the face and a second flat surface contiguous with said first flat surface from an end of said first flat surface in a depth direction of said groove, wherein a first angle between said first flat surfaces of each of said pair of side surfaces is larger than a second angle between said second flat surfaces of each of said pair of side surfaces, and said second flat surfaces of the pair of side surfaces are contiguous with each other at the deepest point of said groove.

2. The golf club head according to claim 1, wherein said groove comprises said pair of side surfaces and a bottom surface, and a width Wr (mm) of said groove measured based on a 30 degrees measurement rule and a cross section area S ($mm^2$) of said groove are expressed as follows:

$$S/(Wr\times 0.5)\times 100\geqq 70(\%).$$

3. The golf club head according to claim 2, wherein said first angle is greater than or equal to 50 degrees and not more than 100 degrees.

4. The golf club head according to claim 2, wherein said first angle is greater than or equal to 10 degrees and not more than 50 degrees, and a boundary portion between said first flat surface and said face is rounded with a radius of equal to or more than 0.05 (mm) and not more than 0.3 (mm).

5. The golf club head according to claim 4, wherein said width Wr (mm) and said cross section area S ($mm^2$) are expressed as follows:

$$S/(Wr\times 0.5)\times 100\geqq 80(\%).$$

6. The golf club head according to claim 2, wherein said first angle is greater than or equal to 50 degrees and not more than 100 degrees, and a boundary portion between said first flat surface and said face is not rounded.

7. The golf club head according to claim 1, wherein said second angle is not more than 30 degrees.

8. The golf club head according to claim 1, wherein a boundary portion between said first flat surface and said face is rounded with a radius of not more than 0.3 (mm).

9. The golf club head according to claim 1, wherein a width Wr (mm) of said groove measured based on a 30 degrees is greater than or equal to 0.6 (mm) and not more than 0.9 (mm).

10. The golf club head according to claim 1, wherein a width Wr (mm) of said groove measured based on a 30 degrees measurement rule and a cross section area S ($mm^2$) of said groove are expressed as follows:

$$S/(Wr\times 0.5)\times 100\geqq 80(\%),$$

wherein said first angle is greater than or equal to 10 degrees and not more than 50 degrees, and wherein a boundary portion between said first flat surface and said face is rounded.

11. The golf club head according to claim 1, wherein a boundary area between the first flat surface and said face is rounded, and the first flat surface is larger than the boundary area.

12. The golf club head according to claim 11, wherein the second flat surface is larger than the boundary area.

* * * * *